US005103086A

United States Patent [19]

Siems et al.

[11] Patent Number: 5,103,086

[45] Date of Patent: Apr. 7, 1992

[54] METHOD OF AND APPARATUS FOR ASCERTAINING THE DENSITY OF A STREAM OF FIBROUS MATERIAL

[75] Inventors: Wolfgang Siems; Matthias Overath, both of Hamburg, Fed. Rep. of Germany

[73] Assignee: Körber AG, Hamburg, Fed. Rep. of Germany

[21] Appl. No.: 525,145

[22] Filed: May 17, 1990

[30] Foreign Application Priority Data

May 19, 1989 [DE] Fed. Rep. of Germany ..... 3916300

[51] Int. Cl.[5] ..... G01N 9/04

[52] U.S. Cl. ..... 250/223 R; 356/239; 209/588

[58] Field of Search ..... 250/222.2, 223 R, 571; 356/239, 429, 430; 209/536, 576-581, 588

[56] References Cited

FOREIGN PATENT DOCUMENTS 2179444 3/1987 United Kingdom .

*Primary Examiner*—David C. Nelms
*Assistant Examiner*—S. Allen
*Attorney, Agent, or Firm*—Peter K. Kontler

[57] ABSTRACT

The density of a trimmed stream of tobacco particles on a radiation-permeable conveyor is ascertained by directing a first beam of infrared light against the trimmed stream so that the light must pass through the stream and through the conveyor prior to reaching a detector which transmits to an evaluating circuit signals denoting the density of the trimmed stream. Such signals are corrected, when necessary, by signals which are generated by a second detector serving to monitor the intensity of infrared light which has passed only through the conveyor, and the corrected signals are used to regulate the operation of a trimming device which converts an untrimmed stream into the trimmed stream. Signals from the second detector indicate the extent of permeability changes of the conveyor as a result of accumulation of solid and/or liquid substances in or on the conveyor, and such signals can further serve to warn the operators that the conveyor is damaged and/or to modify the intensity of light which is caused to pass through the stream and through the conveyor and/or to modify the intensity of light which passes only through the conveyor.

17 Claims, 2 Drawing Sheets

METHOD OF AND APPARATUS FOR ASCERTAINING THE DENSITY OF A STREAM OF FIBROUS MATERIAL

BACKGROUND OF THE INVENTION

The invention relates to improvements in methods of and in apparatus for ascertaining certain characteristics of streams of fibrous material, such as tobacco or filter material for tobacco smoke. More particularly, the invention relates to improvements in methods of and in apparatus for ascertaining the density of a continuous stream of tobacco or other fibrous material while the stream is in the process of being transported by a foraminous conveyor.

It is well known to ascertain the density of a stream of fibrous material by causing the stream to advance across a beam of radiation issuing from a suitable source and impinging upon a detector which serves to generate signals denoting the intensity and/or other characteristics of that portion of the beam which has penetrated all the way through the stream. Such signals can be processed into so-called density signals, i.e., into signals which denote the density of successive increments of the stream advancing between the radiation source and the detector.

Cigarettes, cigarillos, cigars, filter rod sections and other rod-shaped articles of the tobacco processing industry must be tested for a number of reasons, particularly to ascertain their appearance, taste, weight, rate of flow of tobacco smoke toward the mouth of the smoker and/or other characteristics. This is important because the makers of rod-shaped smokers' products (hereinafter called cigarettes for short) expect that the aforenumerated as well as certain other desirable characteristics of the cigarettes remain unchanged for any selected interval of time. This ensures that the smoker can recognize her or his brand, i.e., that the smoker can recognize the preferred brand by taste, feel, rate of flow of tobacco smoke and other characteristics. One of the presently preferred and important procedures to rapidly detect and eliminate changes in the characteristics of various brands is to continuously monitor the density of the rod which is to be sub-divided into discrete cigarettes and/or to monitor the density of discrete cigarettes. The results of density measurement are utilized to influence one or more important steps during making of the cigarettes.

One of the presently preferred procedures which are relied upon to ascertain the density of cigarettes is to use a measuring device which is equipped with a source of corpuscular radiation (such as beta rays) and with an ionization chamber which performs the function of a transducer by generating signals denoting the intensity of radiation which has been emitted by the source and has penetrated all the way through successive increments of a continuous tobacco stream. Reference may be had, for example, to commonly owned U.S. Pat. No. 4,889,139 granted Dec. 26, 1989 to Heitmann.

Published British patent application No. 2 179 444 discloses a different measuring device wherein the radiation source emits optical light. Such light is caused to penetrate through an unwrapped moving stream of fibrous material, and the radiation which has penetrated through and beyond the stream is monitored by an optoelectronic transducer serving to generate appropriate signals which can be processed into signals denoting the density of the respective increments of the moving stream. The arrangement is such that the beam of optical radiation traverses a stream of fibrous material which advances between two spaced-apart channel walls while the stream is being compacted in a direction which is substantially parallel to the two walls and is normal to the direction of advancement of the stream with a foraminous conveyor. The densifying action is furnished by subatmospheric pressure in a suction chamber which is adjacent the stream-advancing reach of the endless foraminous conveyor.

A drawback of the just described density measuring method and apparatus is that the results of density measurement are overly influenced by fluctuations of density of the stream between the source of optical radiation and the optoelectronic transducer. The reason is that the radiation is caused to pass through the stream in a direction at right angles to the direction of compacting action of subatmospheric pressure in the suction chamber.

OBJECTS OF THE INVENTION

An object of the invention is to provide a novel and improved method of ascertaining the density of a moving stream of fibrous material in such a way that the results of measurements are less influenced by fluctuations of density of the stream.

Another object of the invention is to provide a density measuring method which is more reliable and more accurate than heretofore known methods.

A further object of the invention is to provide a method which renders it possible to ascertain the density of a moving stream of tobacco or other fibrous material in such a way that the results of measurements are automatically and continuously corrected in order to compensate for undesirable and unpredictable influences such as the wear upon and/or clogging of and/or other damage to the conveyor which transports the stream along a predetermined path.

An additional object of the invention is to provide a novel and improved method of continuously monitoring the density of a tobacco filler in a cigarette making or other rod making machine.

Still another object of the invention is to provide a novel and improved apparatus for the practice of the above outlined method.

A further object of the invention is to provide the apparatus with novel and improved means for processing signals denoting the intensity of radiation that has passed through and/or has bypassed a stream of fibrous material on a foraminous conveyor.

An additional object of the invention is to provide an apparatus which can be used for the practice of the above outlined method and which can be incorporated into existing cigarette rod making, filter rod making and like machines of the type used in the tobacco processing industry.

A further object of the invention is to provide a cigarette rod making machine which embodies the above outlined apparatus.

SUMMARY OF THE INVENTION

One feature of the present invention resides in the provision of a method of ascertaining the density of a stream of fibrous material, such as a trimmed or equalized stream of tobacco particles or filter material for tobacco smoke. The method comprises the steps of transporting a continuous stream along a predetermined path which is defined by a radiation-permeable conveyor (particularly an endless belt or band conveyor), directing against the stream on the conveyor at least one beam of radiation so that the radiation penetrates through the stream and through the conveyor and the intensity of radiation which has penetrated through the stream and through the conveyor is indicative of density of the stream, monitoring the intensity of radiation which has penetrated through the stream and through the conveyor and generating a density signal which denotes the monitored intensity.

The method can further comprise the steps of directing a second beam of radiation only through the conveyor so that the intensity of that portion of radiation of the second beam which has penetrated through the conveyor alone is indicative of permeability of the conveyor to such radiation, monitoring the intensity of radiation which has penetrated only through the conveyor, and generating a second signal denoting the monitored intensity of radiation that has penetrated only through the conveyor. Such method preferably further comprises the step of modifying the density signal in dependency upon the second signal to thus eliminate or lessen the influence of variations (if any) of permeability of the conveyor upon the density signal.

The method can also comprise the steps of establishing and maintaining a common source of radiation and dividing the radiation issuing from the common source into the at least one beam and into the second beam.

The intensity of radiation can be varied in dependency upon changes (if any) of intensity of the second signal to thus compensate for variations of permeability of the conveyor.

The second signal can be converted into a third signal which denotes the condition (particularly the permeability) of the conveyor.

It is also possible to vary the intensity of radiation in dependency upon changes (if any) of the second signal so as to maintain the intensity of the second signal at least close to a substantially constant value.

At least one of the beams can constitute a beam of optical radiation; for example, at least one of the beams can contain light in the infrared wavelength range.

Another feature of the invention resides in the provision of an apparatus for ascertaining the density of a preferably continuous stream of fibrous material, such as a trimmed or equalized stream of tobacco particles or a stream of fibrous filter material for tobacco smoke. The apparatus comprises a radiation-permeable conveyor which serves to convey the stream along a predetermined path, and density measuring means including a radiation source which directs at least one beam of radiation through the stream in the path and through the conveyor so that the intensity of radiation which has penetrated through the stream and also through the conveyor is indicative of density of the stream. The density measuring means further comprises means for monitoring the intensity of radiation which has penetrated through the stream and through the conveyor, including means for generating a signal which denotes the monitored intensity of radiation, and the apparatus further comprises an evaluating circuit or analogous means for processing the signal into a density signal denoting the density of the stream in the path.

The arrangement is preferably such that the conveyor includes a portion (e.g., one of the upper and lower reaches of an endless foraminous belt or band conveyor) which is located outside of the aforementioned path so that it is not covered by fibrous material. Such apparatus preferably further comprises second measuring means including a second radiation source which serves to direct at least one second beam of radiation only through the uncovered portion of the conveyor so that the intensity of radiation which penetrates through the uncovered portion of the conveyor is indicative of permeability of the conveyor. The second measuring means further comprises means for monitoring the intensity of radiation which has penetrated through the uncovered portion of the conveyor, and the monitoring means includes means for generating a second signal which is indicative of monitored intensity of such radiation, i.e., of radiation which was not permitted to pass through the stream of fibrous material on the conveyor. The processing means can comprise means for converting the second signal into a signal which denotes the permeability of the conveyor.

The apparatus can comprise a common radiation source and means for directing radiation from such common source to the sources of the two measuring means. The means for directing radiation from the common source can comprise optical fibers.

At least one of the measuring means can include a radiation source which emits optical radiation, particularly infrared light.

The processing means can comprise means for modifying the density signal as a function of the second or third signal to thus compensate for the influence of changes (if any) of permeability of the conveyor upon the characteristics of the density signal.

The apparatus can further comprise means for influencing the intensity of radiation which issues from the radiation source of at least one measuring means in dependency upon the second or third signal to thus compensate for the influence of changes (if any) of permeability of the conveyor upon the density signal.

The apparatus can also comprise means for displaying the second and/or the third signal.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
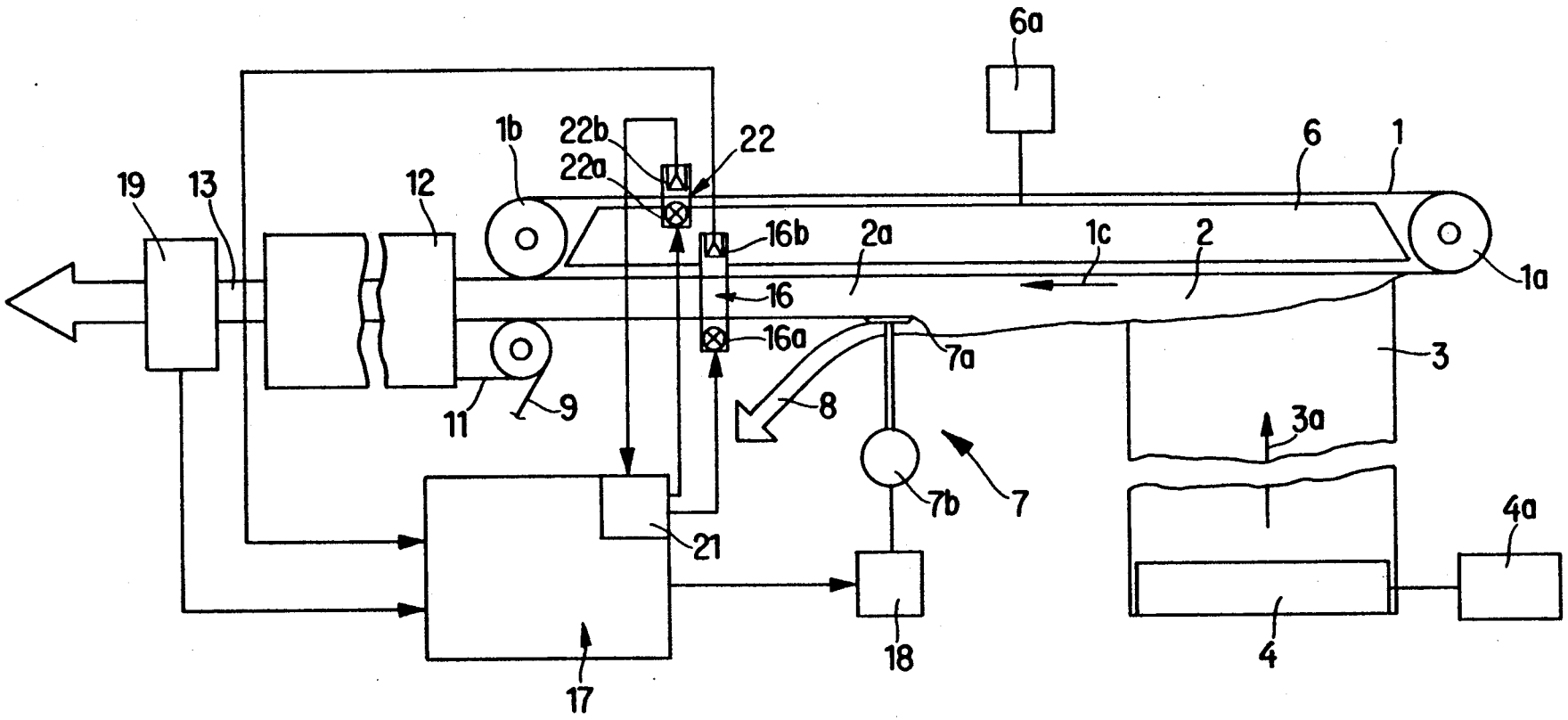
FIG. 1 is a schematic fragmentary elevational view of a cigarette rod making machine embodying a density measuring or ascertaining apparatus which is constructed and assembled in accordance with one embodiment of the present invention.

FIG. 1 shows a portion of a cigarette rod making machine which can be of the type known as PROTOS distributed by the assignee of the present application. The cigarette rod making machine embodies an apparatus which can be utilized for the practice of the improved method, namely to ascertain the density of successive increments of a continuous trimmed stream or filler *2a* of tobacco shreds or other smokable material.

The apparatus includes an endless foraminous belt conveyor 1 which is trained over pulleys 1*a*, 1*b* and serves to advance an untrimmed stream 2 as well as the trimmed (equalized) stream or filler 2*a* (hereinafter called filler) along a predetermined path as indicated by arrow 1*c*, namely with the lower reach of the conveyor 1. At least one of the pulleys 1*a*, 1*b* is driven to advance the conveyor 1 in the direction of the arrow 1*c*, and the lower reach of the conveyor 1 advances along the underside of a foraminous bottom wall forming part of a suction chamber 6 which is connected with the intake of a suction generating device 6*a* (e.g., a fan) by a conduit to ensure that the stream 2 and the filler 2*a* are attracted to and are compelled to advance with the lower reach of the conveyor 1. The cigarette rod making machine further comprises a distributor (also called hopper) with a duct 3 which delivers a shower of tobacco particles in the direction of arrow 3*a*. The particles which form the shower are caused to rise due the (sub-atmospheric) pressure in the chamber 6 and/or due to the action of a rotary impeller 4 which is driven by a motor 4*a*.

The stream 2 is in the process of growing above the open upper end of the duct 3, and the fully grown stream 2 is thereupon converted into the filler 2*a* by a conventional trimming or equalizing device 7, e.g., of the type disclosed in U.S. Pat. No. 3,030,966. Thus, the device 7 can comprise two coplanar rotary discs 7*a* having cooperating marginal portions which clamp the stream 2 at a level between the main portion and the surplus 8, and a rotary brush, a rotary cutting tool or any other suitable implement (not shown) which operates beneath the common plane of the discs 7*a* to segregate the surplus 8 from the filler 2*a*. The surplus 8 is returned into the distributor in a manner not forming part of the present invention.

The discs 7*a* can be moved toward and away from the plane of the lower reach of the conveyor 1 in order to change the rate of removal of surplus 8 from the stream 2. The means for moving the discs 7*a* and the aforementioned implement up and down comprises a servo motor 7*b* which receives appropriate signals from a control circuit 18; the latter, in turn, receives appropriate signals from the corresponding output of a signal evaluating and processing circuit 17.

The filler 2*a* is advanced onto a continuous web 9 of cigarette paper or other suitable wrapping material which is drawn off a bobbin or another source (not shown) by a pair of advancing rolls (not shown) and/or by the upper reach of an endless conveyor belt 11 (called garniture). The belt 11 advances the web 9 and the filler 2*a* into a conventional wrapping mechanism 12 wherein the filler and the web are converted into a continuous cigarette rod 13 which is subdivided into plain cigarettes of unit length or multiple unit length by a so-called cutoff, not shown. The wrapping mechanism 12 compacts the filler 2*a*, and at least one marginal portion of the web 9 is coated with a film of adhesive to ensure the formation of an axially parallel seam when the web 9 is converted into a tubular wrapper of the cigarette rod 13. The plain cigarettes can be transported to storage, to a packing machine or to a filter tipping machine.

The apparatus of FIG. 1 further comprises a density measuring device 16 which is adjacent the path of movement of the or filler 2*a* with the lower reach of the foraminous conveyor 1. This measuring device comprises a radiation source 16*a* at one side of (below) the path for the filler 2*a*, and a radiation monitoring element 16*b* (e.g., an optoelectronic detector) which is located at the other side of the path for the filler 2*a*. The illustrated detector 16*b* is installed in the suction chamber 16 above the lower reach of the conveyor 1, i.e., radiation which has already penetrated through the filler 2*a* must also penetrate through the lower reach of the conveyor 1 before it can reach the detector 16*b*. Such radiation is indicative of density of successive increments of the filler 2.

In accordance with a feature of the present invention, the source 16*a* emits optical radiation, particularly light in the infrared range of the spectrum, and the radiation issuing from this source is caused to penetrate through the filler 2*a* in a direction at right angles to the plane of the lower reach of the conveyor 1. This is in contrast to the proposal in the aforediscussed published British patent application No. 2 179 444 which suggests to direct optical radiation at right angles to the walls bounding a channel for the advancing tobacco stream. Such walls are parallel to the plane of FIG. 1, i.e., they are normal to the plane of the lower reach of the conveyor 1 and are parallel to the direction of propagation of optical radiation from the source 16*a*, through successive increments of the filler 2*a*, thereupon through the respective increments of the lower reach of the conveyor 1, and ultimately into the chamber 6 to impinge upon the detector 16*b*. The source 16*a* can be a composite source, i.e., it can direct two or more beams of optical radiation toward the underside of the filler 2*a* between the trimming device 7 and the web 9 and garniture 11.

The illustrated measuring device 16 is installed immediately or closely downstream of the trimming device 7. This is desirable and advantageous because the interval of time which elapses between the trimming of an increment of the stream 2 and the entry of such increment (portion of the filler 2*a*) into the gap between the radiation source 16*a* and detector 16*b* is extremely short.

The output of the detector 16*b* is connected with the corresponding input of the evaluating or processing circuit 17 which processes the signal denoting the intensity of radiation impinging upon the detector 16*b* into a so-called density signal, i.e., into a signal which denotes the density of the respective increment of the filler 2*a*. The circuit 17 further comprises means (such as a standard comparator circuit,(not specifically shown) which compares the density signal with a reference signal (e.g., a signal which can be furnished by an adjustable potentiometer and denotes the desired density of successive increments of the filler 2*a*. If the actual density signal deviates from the reference signal, the circuit 17 transmits a signal to the control circuit 18 which changes the level of the trimming discs 7*a* by way of the motor 7*b* to thereby change the density of the filler 2*a* by causing the trimming device 7 to remove a larger or smaller quantity of surplus tobacco 8.

The apparatus of FIG. 1 (i.e., the cigarette rod making machine) further comprises an optional nuclear density measuring device 19 which is positioned to ascertain the density of successive increments of the filler in the cigarette rod 13 or of the fillers in discrete cigarettes of unit length or multiple unit length. Signals from the nuclear density measuring device 19 can be used in the evaluating circuit 17 to correct the density signals which are obtained as a result of processing of signals transmitted by the detector 16*b*. The device 19 can comprise a radiation source (e.g., a source of beta rays) at one side of the path of the cigarette rod 13 and an ionization chamber at the other side of the path opposite the radiation source. The output of the ionization chamber of the measuring device 19 is connected with the evaluating circuit 17.

An advantage of the device 19 is that its density measurements are not affected by the ratio of different tobaccos (such as Burley, Oriental and Virginia) in the filler 2a and/or by the color of tobaccos in such mixture. On the other hand, signals which are generated by the detector 16b are likely to be affected by changes of color of tobacco in the filler 2a and/or by changes of the ratio of a mixture of two or more tobaccos. By modifying the density signals in dependency upon the changes of characteristics of signals from the nuclear density measuring device 19, the evaluating circuit 17 can eliminate the influence of changes of color or blend upon the accuracy of signals which are compared with the reference signal prior to serving to adjust the control unit 18 for the motor 7b of the trimming device 7.

Since the signals which are transmitted by the ionization chamber of the density measuring device 19 are not or need not be used to directly influence the level of trimming discs 7a (as in many conventional cigarette rod making machines), the device 19 can employ a rather weak or extremely weak source of corpuscular radiation (such as beta rays). This reduces the problems in connection with proper shielding of persons and/or equipment from nuclear radiation and contributes to lower cost of the entire machine.

It is further clear that the device 19 constitutes but one of numerous available density measuring devices the measurements of which are not affected, or are not overly affected, by the color and/or blend of tobacco forming the filler 2a and which, therefore, can be used to generate signals serving to correct the signals which are transmitted by the output of the detector 16b and are convertible into density signals. Furthermore, the device 19 and/or an equivalent of this device can be omitted or deactivated if the rod making machine is expected to process only a selected blend of tobacco having an unchanging or practically unchanging color so that the likelihood of generation of distorted signals by the detector 16b is very remote.

As mentioned above, the feature that the beam of radiation issuing from the source 16a is directed toward and penetrates through the filler 2a in a direction at right angles to the plane of the lower reach of the conveyor 1 ensures that the accuracy of signals at the output of the detector 16b is not affected by variations of density of different layers or strata of the filler. In other words, the intensity of signals from the detector 16b is always affected by changes of density of ally layers of the filler 2a between the conveyor 1 and the exposed side of the filler.

Particles of dust, other solid matter and/or droplets of moisture which is expelled from the stream 2 and/or filler 2a are likely to gather on and/or in the foraminous belt conveyor 1, and such foreign substances affect the permeability of the conveyor which, in turn, affects the intensity of signals at the output of the detector 16b. Penetration of foreign solid and/or liquid substances into the interstices, or their accumulation on the exposed surface, of the conveyor 1 is promoted by the flow of air which is drawn by the suction chamber 6 and passes through the untrimmed stream 2 and the filler 2a when the cigarette rod making machine is in use. Gradual changes of permeability of the conveyor 1 are likely to eventually entail appreciable changes of signals which are generated by the detector 16b and hence of signals which the evaluating circuit 17 transmits to the control circuit 18 for the motor 7b of the trimming device 7. In other words, the permeability of the conveyor 1 cannot be considered as a fixed (unchanging) value.

In accordance with a feature of the invention, the improved apparatus further comprises a second measuring device 22 which is positioned to ascertain the permeability of a portion (upper reach) of the belt conveyor 1, namely a portion or section which does not carry tobacco particles. The device 22 includes a radiation source 22a which is or can be installed in the suction chamber 6 beneath the upper reach of the conveyor 1, and a signal generating optoelectronic transducer or detector 22b which is located above the upper reach opposite the radiation source 22a and transmits to the corresponding input of the evaluating circuit 17 signals denoting the actual permeability of the conveyor 1. The circuit 17 processes the signals from the detector 22b and utilizes such signals for correction or modification of signals from the detector 16b so as to eliminate the signal distorting influence of varying permeability of the conveyor 1 upon the signals which are being transmitted to the control circuit 18. For example, the evaluating circuit 17 can compare signals from the detector 22b with a reference signal denoting the permeability of the conveyor prior to any clogging with solid and/or liquid substances, and the thus obtained difference signals are used as correction signals for those signals which are transmitted by the detector 16b. Thus, the signals which the evaluating circuit 17 transmits to the motor 7b via control circuit 18 are not influenced by changes in permeability of the conveyor 1 and, therefore, these signals more accurately reflect the density of the filler 2a; in fact, signals from the control circuit 18 to the motor 7b are or can be indicative solely or exclusively of the density of successive increments of the filler 2.

It is also possible to utilize the signals from the detector 22b of the second measuring device 22 to influence the intensity of radiation which is emitted by the source 16a and/or 22a as a function of changes of permeability of the conveyor 1. Such utilization of signals from the detector 22b can be resorted to in addition to or in lieu of correction of signals from the detector 16b. FIG. 1 shows that the evaluating circuit 17 comprises a module 21 which serves to regulate the intensity of radiation issuing from the sources 16a and 22a so that the intensity of radiation reaching the detector 22b is constant, i.e., the intensity of radiation from the source 22a is altered proportionally with changes of permeability of the conveyor 1. Thus, when the permeability of the conveyor 1 decreases, the intensity of radiation issuing from the source 22a is increased to such an extent that the intensity of signals at the output of the detector 22b remains constant or reassumes a predetermined value. Inversely, the intensity of radiation issuing from the source 22a decreases when the permeability of the conveyor 1 to such radiation increases. This also entails a compensation for the influence of variations of permeability of the conveyor 1 upon the accuracy of density measurements by the device 16.

Figure 2:
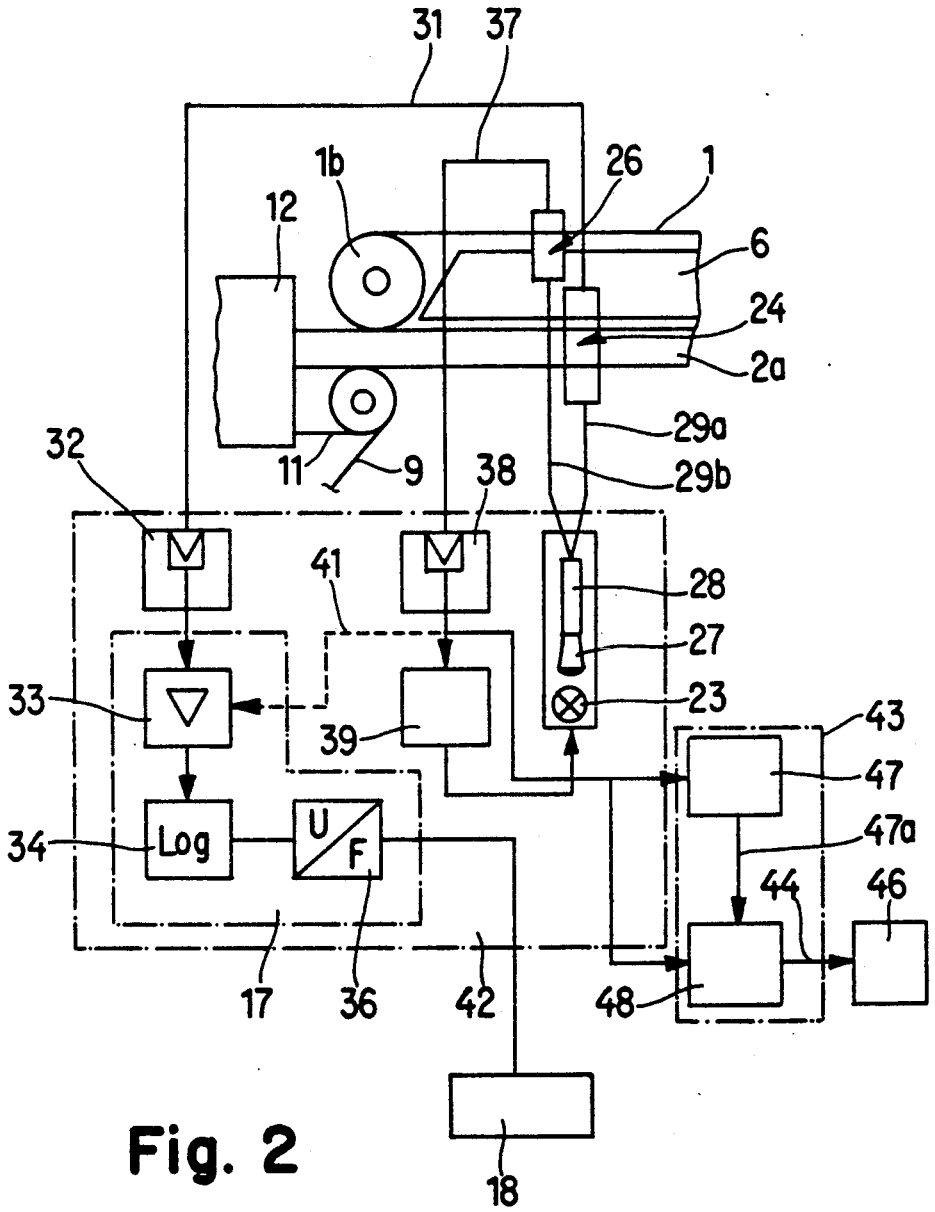
FIG. 2 is a fragmentary diagrammatic view of a modified density measuring apparatus.

FIG. 2 shows a portion of a modified apparatus wherein a common radiation source 23 is provided for two measuring devices 24, 26 respectively replacing the measuring devices 16, 22 of FIG. 1. Radiation issuing from the common source 23 passes through a collector lens 27 and into a light conductor 28 having branches 29*a*, 29*b* which can be said to constitute radiation sources of the devices 24 and 26, respectively. Radiation which issues from the branch 29*a* passes through the filler 2*a* and thereupon through the lower reach of the conveyor 1 prior to entering a light conductor 31 serving to convey radiation to a detector 32 of the device 24. The intensity of signals which are transmitted by the detector 32 is indicative of density of the filler 2*a* and of permeability of the conveyor 1. Signals which are transmitted by the detector 32 are amplified by an operational amplifier 33 of the evaluating circuit 17. The thus amplified signals are processed in a logarithming module 34 of the evaluating circuit 17 prior to being transmitted to a voltage-frequency converter 36. Evaluating circuits 17 of the type shown in FIG. 2 are known in the art. Reference may be had to evaluating circuits of the type known as SRM which are distributed by the assignee of the present application.

The signals at the output of the voltage-frequency converter 36 can be transmitted to the control unit 18 to regulate the operation of the motor 7*b* in the trimming device 7 (not shown in FIG. 2).

The conductor 29*b* can be said to constitute the radiation source of the measuring device 26 and causes the corresponding portion of radiation issuing from the common source 23 to penetrate only through the upper reach of the conveyor 1 (i.e., through that portion of the conveyor which is not coated with tobacco particles). The intensity of radiation which has penetrated through the upper reach of the conveyor 1 is monitored by a detector 38 which receives radiation from an optical light conductor 37. The output of the detector 38 transmits signals to a regulator 39 which converts the incoming signals into those denoting the permeability of the upper reach of the conveyor 1. The regulator 39 regulates the intensity of radiation issuing from the common source 23 in such a way that the intensity of signals which are transmitted by the detector 38 of the second measuring device 26 remains constant or rapidly or immediately assumes a predetermined value as soon as it begins to depart from such predetermined value. As already described with reference to FIG. 1, this also entails a compensation for the influence of varying permeability of the conveyor 2 upon the accuracy of density measurements which are carried out by the device 24, i.e., upon the accuracy of density signals which are used to adjust the motor 7*b* of the trimming device 7 by way of the control circuit 18.

The broken line 41 denotes in FIG. 2 an operative connection between the output of the detector 38 and the corresponding input of the operational amplifier 33. Such connection enables the amplifier 33 to influence the signal from the detector 32 in dependency upon the characteristics of the signal from the detector 38. Such mode of correction of signals from the detector 32 is analogous to that of correcting signals from the detector 16*b* in dependency upon the characteristics of signals from the detector 22*b* by the evaluating circuit 17 of FIG. 1.

It is often desirable and advantageous to assemble the detectors, the radiation source or sources, the means for adjusting the intensity of the radiation source or sources, and at least some components of the evaluating circuit into a single (combined sender and receiver) module 42 which is indicated in FIG. 2 by phantom lines. Such module can be installed in or combined with existing cigarette rod making machines or other machines for the processing of streams of fibrous material which are transported by radiation-permeable conveyors.

FIG. 2 shows that the common radiation source 23 is a single source of light, such as infrared light. However, it is equally within the purview of the invention to employ two or more discrete radiation sources (e.g., two or more infrared light emitting diodes) for admission of light into the conductor 28. The latter can comprise or consist of a bundle of optical fibers, the same as the light conductor 31 and/or 37.

Signals which are transmitted by the detector 32 of the measuring device 26 can also serve to monitor the condition of the conveyor 1, i.e., to ascertain the permeability of the conveyor during each and every stage of operation of the rod making machine. This is desirable and advantageous because the persons in charge of the rod making machine can ascertain, in good time, the extent of wear upon and/or other defects of the conveyor 1 in order to ensure timely replacement. To this end, the output of the detector 38 is connected with one input of a signal converting or switching circuit 43 including an averaging circuit 47. The latter generates a signal denoting the average permeability of the conveyor 1.

Conveyor portions which exhibit extensive wear as well as breaks or cracks in the conveyor 1 entail localized increases of permeability. Such defects are detectable due to the provision in the switching circuit 43 of a signal comparing stage 48 which receives averaged signals from the output 47*a* of the averaging circuit 47 and which further receives signals directly from the output of the detector 38. When the intensity of signal from the output of the detector 38 exceeds the intensity of averaged signal from the output 47*a* by a preselected value, the output 44 of the signal comparing stage 48 transmits a signal to a signal displaying unit 46 which can be designed to generate, in good time, audible and/or visible and/or other signals in order to inform the attendant or attendants that the conveyor 1 warrants inspection for the purposes of replacement or repair.

An important advantage of the apparatus which embodies the structure of FIG. 2 is that drifting of the intensity of radiation from the radiation sources (conductors) 29*a* and 29*b* cannot influence the accuracy of measurements of density of the filler 2*a*. This is due to the provision of the common radiation source 23, i.e., drifting (if any) which influences the intensity of radiation from the source 29*a* is identical with drifting which influences the intensity of radiation issuing from the source 29*b*.

The sources 16*a*, 22*a* and 23 preferably emit light in the infrared wavelength range. Such radiation is preferred by many manufacturers of smokers' products over corpuscular radiation. If provided, the density measuring device 19 merely serves to furnish a density signal which is not influenced by the color and/or blend of particles forming the stream 2 and the filler 2*a*. As explained above, the device 19 can employ a very weak source of corpuscular radiation because its signals are merely used as reference signals, or for the generation of reference signals, rather than to actually adjust the motor 7*b* of the trimming device 7.

Another important advantage of the improved method and apparatus is that radiation from the source 16*a*, 22*a* and/or 23 can be caused to propagate itself at right angles to the plane of the lower reach of the conveyor 1, i.e., at right angles to that portion of the conveyor which defines the path for the stream 2 and filler 2*a*. This reduces the likelihood of unpredictable influencing of the radiation by variations of density in different strata of the stream 2 and filler 2*a*, namely in different strata which are parallel to the lower reach of the conveyor 1. Thus, the density measuring action is more uniform because the radiation is caused to pass through each and every layer of the stream and/or filler irrespective of variations of density from layer to layer. For example, the layer which is immediately adjacent the lower reach of the conveyor 1 is likely to be denser than the lowermost or outermost layer of the stream.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of ascertaining the density of a stream of fibrous material, such as a stream of tobacco particles, comprising the steps of transporting the stream along a predetermined path which is defined by a radiation-permeable conveyor; directing against the stream on the conveyor at least one beam of radiation so that the radiation penetrates through the stream and through the conveyor and the intensity of radiation which has penetrated through the stream and through the conveyor is indicative of density of the stream; monitoring the intensity of radiation which has penetrated through the stream and through the conveyor; generating a density signal denoting the monitored density; directing a second beam of radiation only through the conveyor so that the intensity of radiation of the second beam which penetrates through the conveyor is indicative of permeability of the conveyor to such radiation; monitoring the intensity of radiation which has penetrated only through the conveyor; generating a second signal denoting the monitored intensity of radiation which has penetrated only through the conveyor; and modifying the density signal in dependency upon the second signal to eliminate the influence of variations, if any, of permeability of the conveyor upon the density signal.

2. The method of claim 1, further comprising the steps of establishing and maintaining a source of radiation and dividing the radiation issuing from said source into said at least one beam and into said second beam.

3. The method of claim 1, wherein said modifying step includes varying the intensity of radiation in dependency upon changes, if any, of intensity of the second signal to compensate for variations of permeability of the conveyor.

4. The method of claim 1, further comprising the step of converting the second signal into a third signal denoting the condition of the conveyor.

5. The method of claim 1, wherein said modifying step includes varying the intensity of radiation in dependency upon changes, if any, of the second signal so as to maintain the intensity of the second signal at least close to a substantially constant value.

6. The method of claim 1, wherein said at least one beam contains optical radiation, particularly infrared light.

7. The method of claim 1, wherein each of said beams is a beam of optical radiation.

8. The method of claim 7, wherein each of said beams contains infrared light.

9. Apparatus for ascertaining the density of a stream of fibrous material, such as a stream of tobacco particles, comprising a radiation-permeable conveyor arranged to convey the stream along a predetermined path, said conveyor comprising a portion which is located outside of said path; density measuring means including a radiation source arranged to direct at least one beam of radiation through the stream in said path and through said conveyor whereby the intensity of radiation which has penetrated through the stream and through the conveyor is indicative of density of the stream, and means for monitoring the intensity of radiation which has penetrated through the stream and through the conveyor, including means for generating a signal denoting the monitored intensity of radiation; means for processing said signal into a density signal denoting the density of the stream in said path; second measuring means including a second radiation source arranged to direct at least one second beam of radiation only through said portion of said conveyor so that the intensity of radiation penetrating through said portion is indicative of permeability of the conveyor, and means for monitoring the intensity of radiation that penetrates through said portion of the conveyor, including means for generating a second signal denoting the monitored intensity of such radiation; and means for modifying said density signal in dependency upon said second signal to eliminate the influence of changes, if any, of permeability of said conveyor upon the density signal.

10. The apparatus of claim 9, wherein said processing means comprises means for converting the second signal into a signal denoting the permeability of said conveyor.

11. The apparatus of claim 9, wherein at least one of said sources emits optical radiation, particularly infrared light.

12. The apparatus of claim 9, wherein said processing means comprises means for converting the second signal into a third signal denoting the permeability of said conveyor.

13. The apparatus of claim 9, wherein said processing means includes means for converting the second signal into a third signal denoting the permeability of said conveyor, said modifying means comprising means for influencing the intensity of radiation issuing from at least one of said radiation sources in dependency upon said third signal to compensate for influence of changes, if any, of permeability of the conveyor upon the density signal.

14. The apparatus of claim 9, wherein said processing means includes means for converting said second signal into a third signal denoting the permeability of the conveyor and further comprising means for displaying said third signal.

15. The apparatus of claim 9, wherein said source emits optical radiation, particularly infrared light.

16. The apparatus of claim 9, further comprising a common radiation source and means for directing radiation from said common source to the sources of said measuring means.

17. The apparatus of claim 16, wherein said radiation directing means comprises optical fibers.

* * * * *